US008867316B2

(12) United States Patent
Tran et al.

(10) Patent No.: US 8,867,316 B2
(45) Date of Patent: Oct. 21, 2014

(54) SUPPORT FOR DISPLAY MEMBER OF A TIMEPIECE MOVEMENT

(71) Applicant: Pequignet S.A., Morteau (FR)

(72) Inventors: Huy Van Tran, La Chaux-de-Fonds (CH); Ludovic Perez, Villers-le-Lac (FR)

(73) Assignee: Pequignet S.A., Morteau (FR)

( * ) Notice: Subject to any disclaimer, the term of this patent is extended or adjusted under 35 U.S.C. 154(b) by 0 days.

(21) Appl. No.: 14/034,467

(22) Filed: Sep. 23, 2013

(65) Prior Publication Data

US 2014/0022870 A1 Jan. 23, 2014

Related U.S. Application Data

(63) Continuation of application No. PCT/EP2012/055270, filed on Mar. 23, 2012.

(51) Int. Cl.

| | |
|---|---|
| ***G04B 19/02*** | (2006.01) |
| ***G04B 19/20*** | (2006.01) |
| ***G04B 19/26*** | (2006.01) |
| ***G04B 27/00*** | (2006.01) |
| ***G04B 29/04*** | (2006.01) |
| *G04B 19/253* | (2006.01) |

(52) U.S. Cl.

CPC ..... *G04B 19/02* (2013.01); *G04B 19/25373* (2013.01); *G04B 19/268* (2013.01); *G04B 27/005* (2013.01); *G04B 29/04* (2013.01)

USPC ..... 368/18; 368/38; 368/220

(58) Field of Classification Search

CPC ..... G04B 19/02; G04B 19/268; G04B 19/25373; G04B 27/005

USPC ..... 368/15–19, 28, 34, 37, 38, 190, 195, 368/220

See application file for complete search history.

(56) References Cited

U.S. PATENT DOCUMENTS

| | | | | |
|---|---|---|---|---|
| 3,659,413 | A * | 5/1972 | Tanaka et al. | 368/34 |
| 3,888,076 | A * | 6/1975 | Zaugg et al. | 368/38 |
| 4,259,735 | A | 3/1981 | Vuille | |
| 2005/0152225 | A1* | 7/2005 | Dias | 368/77 |
| 2010/0188937 | A1* | 7/2010 | Watanabe | 368/37 |

FOREIGN PATENT DOCUMENTS

| | | | |
|---|---|---|---|
| CH | 692 166 | A5 | 2/2002 |
| EP | 0 008 832 | A2 | 3/1980 |
| EP | 1 406 131 | A1 | 4/2004 |
| FR | 2 165 705 | A1 | 8/1973 |

OTHER PUBLICATIONS

International Search Report of PCT International Application No. PCT/EP2012/055270, dated Sep. 5, 2012, 4 pages.

Preliminary Search Report of FR 1152405, dated Dec. 14, 2011, 2 pages.

* cited by examiner

*Primary Examiner* — Vit W Miska

(74) *Attorney, Agent, or Firm* — Finnegan, Henderson, Farabow, Garrett & Dunner, LLP

(57) ABSTRACT

A support for a mechanism for displaying jumping-type information for a timepiece movement is disclosed. The mechanism may include a display member driven in rotation via a driving star wheel. The support may be positioned between the display member and a frame element of the timepiece movement. The support may include a base that may include at least one first hole configured to receive a shaft for rotating the display member. The support may also include a first arm extending from the base and arranged to ensure the function of a jumper for the driving star wheel, and a second arm extending from the base and arranged to act on the driving star wheel to cause the driving star wheel to rotate in order to correct information displayed in response to a predefined action of a user that deforms the second arm.

20 Claims, 3 Drawing Sheets

SUPPORT FOR DISPLAY MEMBER OF A TIMEPIECE MOVEMENT

This application is a continuation application of prior International Application No. PCT/EP2012/055270, filed Mar. 23, 2012 and claiming priority to French (FR) Patent Application No. 1152405, filed Mar. 23, 2011. The disclosures of the above-referenced applications are expressly incorporated herein by reference to their entireties.

TECHNICAL FIELD

The present disclosure relates to the field of timepieces. More particularly, and without limitation, the present disclosure relates to a support for a mechanism for displaying jumping-type information for a timepiece movement. The mechanism may comprise a display mobile that may be driven in rotation via a driving star wheel. The support may be positioned between a display member and a frame element of the timepiece movement.

The present disclosure also relates to a display mechanism comprising such a support, as well as a timepiece movement. The present disclosure further relates to a timepiece comprising such a timepiece movement.

BACKGROUND

Many display mechanisms of a jumping type are known in the art. Typically, these display mechanisms are arranged on the bottom plate of the corresponding timepiece movement and comprise a display mobile, a driving star wheel, and a jumper, making it possible to define stable positions of the driving star wheel, all these elements being borne directly by the bottom plate. An example of such a mechanism is disclosed in the patent application EP 1 406 131 A1.

Furthermore, it is common practice to provide an additional correction mechanism for adjusting the value of the information displayed, often by pressure from a user on a corrector.

However, it should be noted that the assembly of all these elements is difficult and sometimes requires alterations to certain elements to guarantee the correct operation of the mechanism.

SUMMARY

The present disclosure includes embodiments that improve on conventional solutions and overcome the drawbacks of conventional display mechanisms of a jumping type known in the art, by proposing such a display mechanism whose assembly is simplified, among other things.

The present disclosure relates more particularly to embodiments that provide a support for a display mechanism of a jumping type, which may comprise a base including at least one first hole configured to receive a shaft for rotating the display member, and from which extend a first arm arranged in such a way as to ensure the function of a jumper for the driving star wheel, and a second arm arranged in such a way as to act on the driving star wheel to rotate it in order to correct the information to be displayed in response to a predefined action of a user aiming to deform the second arm.

By virtue of these features, a display mechanism incorporating such a support may offer simplified assembly compared to conventional display mechanisms. In practice, the relative positions of the display mobile, the jumper, and a correction member may be defined directly by one and the same member, e.g., the support. All that is then required to guarantee correct operation of the display mechanism according to embodiments of the present disclosure may be to ensure the correct relative positioning between the driving star wheel and the support.

Advantageously, the second arm may comprise, from the base and toward its free end terminated by an actuating pawl, a first portion of reduced transversal dimensions followed by a second portion of transversal dimensions greater than those of the first portion. Furthermore, a corrector receiving surface may be formed on the second portion, for example, in a region closest to the first portion.

The first portion of the second arm may be deformed more easily than the second portion. Because of this, when a pressure is exerted on the receiving surface, as a consequence of the action of the user, the first portion of the second arm may be deformed to allow its free end to come into contact with the driving star wheel and exert a pressure thereon aiming to rotate it, in order to correct the value of the information displayed.

The present disclosure also relates to a flexible display mechanism. According to some embodiments, the support may comprise at least one second hole configured to receive the shaft for rotating the display member. More specifically, the corresponding timepiece movement may comprise a display mechanism arranged in such a way that the first and second holes are substantially aligned with the center of the timepiece movement. The first and second holes may be substantially equidistant from the point of intersection between a radius that passes through the first and second holes, and a straight line perpendicular to the radius and also cutting the axis of rotation of the driving star wheel.

By virtue of these features, the display mobile may be arranged to pivot in either one of the first and second holes, as chosen by the manufacturer, without the rest of the mechanism having to undergo any additional modification. It will be noted in particular that, because of the positions of the first and second holes, the distance between the display mobile and the driving star wheel may be the same regardless of which hole is used to house the shaft of the display mobile. Such a property may confer great flexibility in the construction of a timepiece, in particular if a plurality of complications are provided, as in the design of the dial plate. In practice, the display mobile may be displaced along the radius passing through the first and second holes with no particular modification to the mechanism.

Advantageously, the corresponding timepiece movement may comprise a display mobile including an information display member and mounted to pivot in a bearing attached to the support via one of the first and second holes. The display mobile may also comprise a first toothed wheel, attached in rotation to the information display member and arranged to be engaged with a second wheel that may be attached in rotation to the driving star wheel.

The first wheel may be driven onto a cylindrical seating of the display member. Thus, the display member may be modified with no impact on its driving mechanism.

Moreover, it is advantageously possible to provide for the support to be arranged on a frame element of the timepiece movement in such a way that the receiving surface of the second arm may be accessible from a side of the timepiece movement in a radial direction, notably to allow for it to be actuated by the corrector.

Mechanisms according to embodiments of the present disclosure is particularly, but not exclusively, suited to displaying phases of the Moon.

BRIEF DESCRIPTION OF THE DRAWINGS

Other features and advantages of the present disclosure will become more clearly apparent on reading the following detailed description, given with reference to the appended drawings, which are provided by way of non-limiting examples, and in which.

DETAILED DESCRIPTION OF EMBODIMENTS

Figure 1:
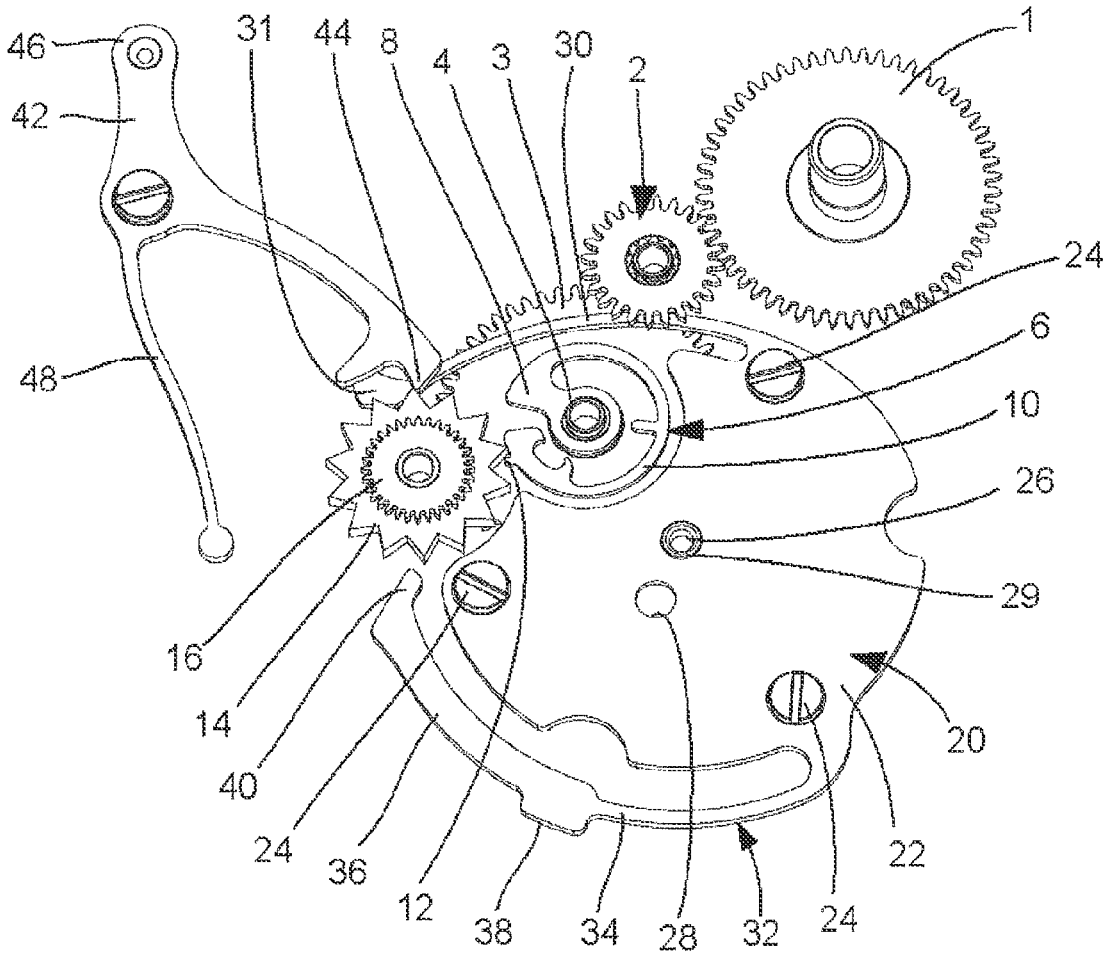
FIG. 1 shows a simplified perspective view of an exemplary display mechanism, according to an embodiment of the present disclosure.

FIG. 1 shows a simplified perspective view of an exemplary display mechanism, according to an embodiment of the present disclosure. More specifically, FIG. 1 shows an exemplary mechanism for displaying the phases of the Moon, in a non-limiting illustrative manner.

The display mechanism may be driven from a mobile of a timepiece movement, which may be an hour wheel 1. The mechanism may comprise a first mobile 2 arranged to be engaged with the hour wheel 1 by its wheel and with an intermediate wheel 3 by its pinion (not visible). The intermediate wheel 3 may be driven onto a bush 4 to be attached thereto in rotation.

An actuating spring 6 may be mounted on a bush 4 by a base 8. The bush 4 may include a flat surface on its periphery. The base 8 of the actuating spring 6 may include a central opening of complementary form to securely attach the actuating spring 6 to the bush 4 in rotation.

An arm 10, which may be elastically deformable, may extend from the base 8 with substantially the form of a ring. The arm 10 may include an actuating pawl 12, in proximity to its free end, having a substantially radial flank and an inclined flank, the latter facilitating the retraction of the actuating pawl during correction operations.

A gear train comprising the mobile 2 and the intermediate wheel 3 is configured in such a way that the actuating spring 6 may perform a complete rotation on itself in, e.g., twenty four hours. A driving star wheel 14 with, e.g., fourteen teeth, may be arranged in reach of the actuating pawl 12 to be driven in rotation by one step every twenty four hours.

Figure 3:
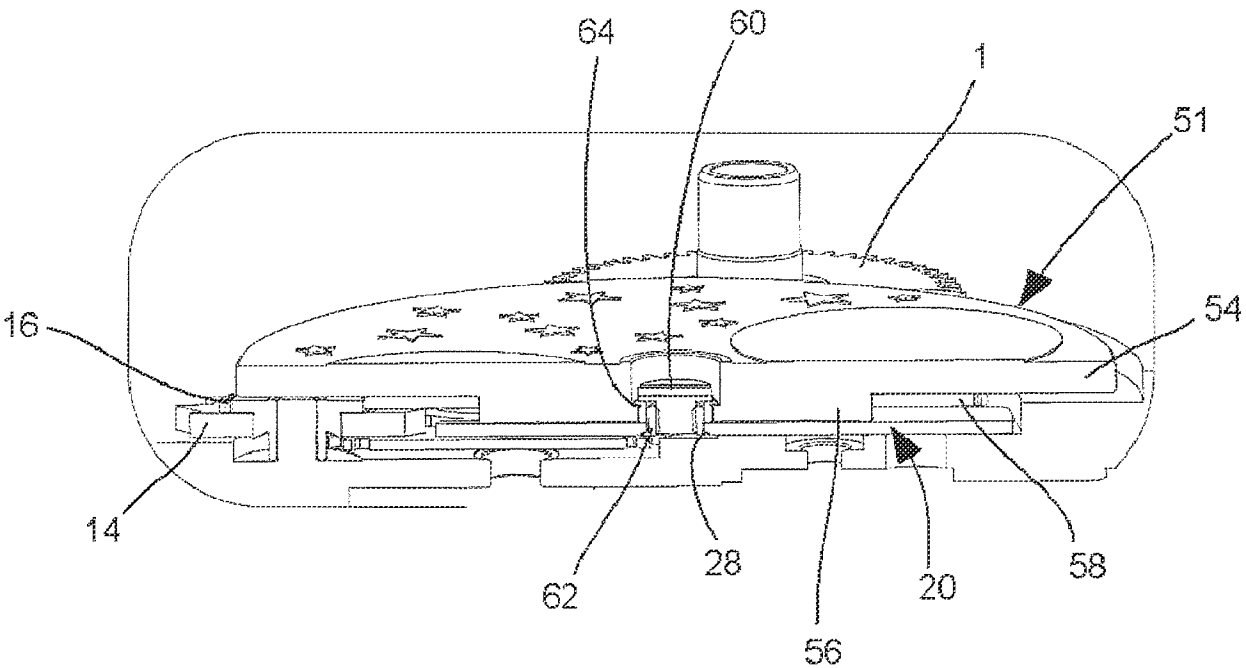
FIG. 3 shows a simplified transversal cross-sectional view of the exemplary display mechanism of FIG. 2, along the cut line III-III of FIG. 2, according to an embodiment of the present disclosure.

A driving wheel 16 with, e.g., thirty two teeth, coaxial to the driving star wheel 14 and attached thereto in rotation, may be provided to drive in rotation a mobile for displaying the phases of the Moon (visible in FIG. 3). A support 20, or support plate 20, may be arranged in proximity to the driving star wheel 14.

The support 20 may comprise a base 22 that may be configured to be securely attached to a frame element of the timepiece movement by means of, e.g., three screws 24. The base 22 may include first and second holes 26 and 28, the function of which will be explained below, in relation to FIG. 2. A tube 29 defining a bearing may be housed in the hole 26.

A first arm 30 may extend from the base 22 and toward the driving star wheel 14 to define a jumper spring. In particular, a free end 31 of the first arm 30 may include two inclined planes arranged to cooperate with the teeth of the driving star wheel 14 and define stable angular positions thereof.

A second arm 32 may extend from the base 22, also toward the driving star wheel 14. The second arm 32 may include a first portion 34, of reduced transversal dimensions, and followed by a second portion 36 of greater transversal dimensions. Furthermore, a corrector receiving surface 38 may be formed in the region of the second portion 36 closest to the first portion 34. A free end 40 of the second arm 32 may be situated in proximity to the teeth of the driving star wheel 14.

Advantageously, provision may be made to have a corrector (not shown) facing the receiving surface 38, in such a way that the second arm 32 may be deformed in response to a pressure exerted by a user on the corrector. As a consequence of this deformation, the free end 40 of the second arm 32 may come into contact with the teeth of the driving star wheel 14 and may exert thereon a force tending to make the driving star wheel 14 rotate, e.g., in a counter-clockwise direction of rotation, resulting in a correction of the value displayed by the display mobile.

Advantageously, but in a non-limiting manner, all the members that have been described above may be assembled on a bottom plate of a timepiece movement.

Thus, the assembly of the display mechanism according to the disclosure may be substantially simplified compared to mechanisms known in the art. In practice, the jumper and the correction member (e.g., the second arm 32) may be made of one part with the support ensuring the positioning of the display mobile, thus simplifying the relative positioning between these parts.

Depending on the space available on the frame of the timepiece movement, an additional correction mechanism may be provided, which may be capable of being actuated by a user from a point that is distant from that where the receiving surface 38 is situated. In some embodiments, such a correction mechanism may, for example, include a rocker 42, mounted to rotate on the frame of the timepiece movement and comprising an additional correction pawl 44 arranged to be able to rotate the driving star wheel 14 in response to a pressure exerted on an additional receiving surface 46. The rocker 42 may advantageously include a return spring 48 formed by one part therewith.

Figure 2:
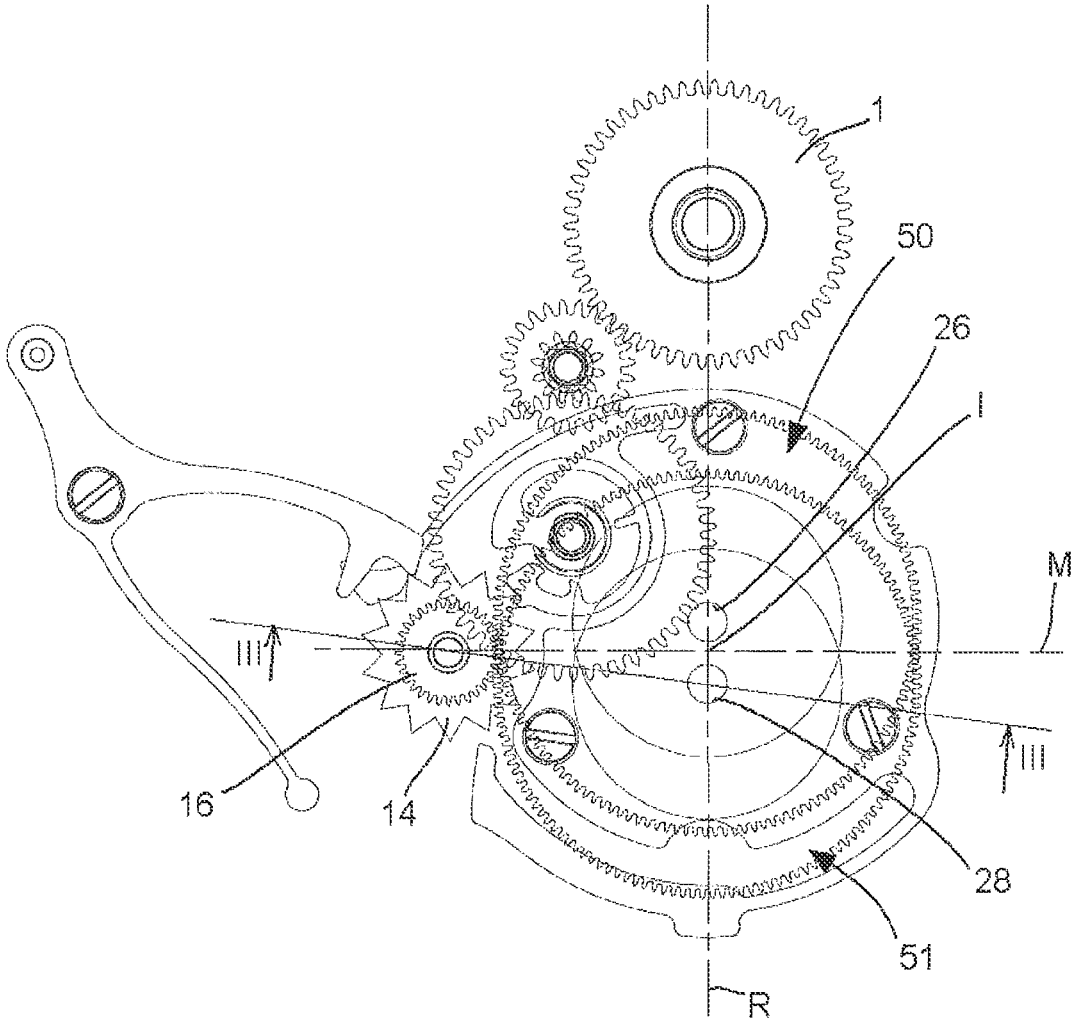
FIG. 2 illustrates a simplified front view of the exemplary display mechanism of FIG. 1, in first and second configurations, according to an embodiment of the present disclosure.

FIG. 2 illustrates a simplified front view of the exemplary display mechanism of FIG. 1. More specifically, a display mobile is illustrated in addition to the elements already described. The display mobile is illustrated in its first and second positions, identified differently by the numeric references 50 and 51.

FIG. 2 shows that the first and second holes 26 and 28 of the support 20 may be formed in specific positions of the support. More particularly, the first and second holes 26 and 28 may be aligned with the axis of rotation of the hour wheel, in other words, the first and second holes 26 and 28 may be situated on one and the same radius R of the timepiece movement. Furthermore, the first and second holes 26 and 28 may be substantially equidistant from the point of intersection I between the straight line M, which is perpendicular to the radius R and which cuts the axis of rotation of the driving star wheel 14, and the radius R. In other words, the first and second holes 26 and 28 may define between them a segment forming the base of an isosceles triangle whose third vertex is situated on the axis of rotation of the driving star wheel 14.

The display mobile (as shown at first and second positions 50 and 51) may comprise a wheel with, e.g., one hundred and thirty five teeth and arranged to be engaged with the driving wheel 16.

It can be observed in FIG. 2 that, because of their particular positions, the first and second holes 26 and 28 make it possible to mount the display mobile in either one of the two holes, without distinction, while ensuring the meshing between its wheel and the driving wheel 16.

Thus, the display mobile may be mounted on the frame of the timepiece movement according to the first and second positions 50 and 51, respectively closer to and further way from the center of the timepiece movement.

As stated above, such a feature provides great flexibility for the manufacturer of the timepiece movement and for the designer responsible for designing the dial plate of the corresponding timepiece.

FIG. 3 represents a simplified transversal cross-sectional view of the exemplary display mechanism of FIG. 2, along the cut line III-III of FIG. 2.

The display mobile can be seen in its position referenced 51 in FIG. 3, whereas it is pivoted in the second hole 28.

An exemplary construction of the display mobile is illustrated in FIG. 3.

The display mobile may comprise a display member 54 configured for displaying information, e.g., the phases of the Moon. The display member may have an overall form of a disk.

A seating 56 may be formed on its bottom face, on which there may be force-fitted a toothed wheel 58 meshing with the driving wheel 16. In the exemplary construction shown in FIG. 3, the dimensions of the display member may be independent of those of the toothed wheel 58 and may be modified according to specific needs, advantageously with no impact on the construction of the driving mechanism of the display member 54.

In addition, in the exemplary construction shown in FIG. 3, the display mobile may be mounted to rotate on the frame of the timepiece movement by means of a screw 60 engaged in a screw foot 62. The display member 54 may be attached to a ring 64 ensuring its correct rotation on the screw foot 62.

The above descriptions serve as non-limiting illustrations, and the disclosure is not limited to the implementation of certain particular features which have been described, such as, for example, the structure of the driving mechanism or the forms represented for its different component parts.

In particular, it will be noted that the display member fastening mode, as described, is non-limiting and will be able to be produced differently, such as, for example, by arranging the assembly on a ball bearing or on a post. Similarly, as described previously, the disclosure is not limited to displaying the phases of the Moon. Any other suitable information can be displayed without departing from the framework of the disclosure.

A person skilled in the art will not have any particular difficulty in adapting the content and embodiments of the present disclosure to his or her own needs and implementing a display mechanism of jumping type comprising a support directly forming a jumper and a correction member, without departing from the framework of the present disclosure.

What is claimed is:

1. A support for a mechanism for displaying jumping-type information for a timepiece movement, the mechanism comprising a display member driven in rotation via a driving star wheel, the support being positioned between said display member and a frame element of the timepiece movement, wherein the support comprises:

a base comprising at least one first hole configured to receive a shaft for rotating the display member;

a first arm extended from the base and arranged to ensure the function of a jumper for the driving star wheel; and a second arm extended from the base and arranged to act on the driving star wheel to cause the driving star wheel to rotate in order to correct information displayed in response to a predefined action of a user that deforms said second arm.

2. The support of claim 1, wherein said second arm comprises, from said base and toward a free end terminated by an actuating pawl:

a first portion of reduced transversal dimensions followed by a second portion of transversal dimensions greater than those of said first portion; and a corrector receiving surface being formed on said second portion.

3. The support of claim 1, further comprising at least one second hole configured to receive the shaft for rotating the display member.

4. The support of claim 2, further comprising at least one second hole configured to receive the shaft for rotating the display member.

5. A mechanism for displaying jumping-type information for a timepiece movement, comprising:

a driving star wheel;

a display member configured to be driven in rotation via said driving star wheel; and a support positioned between said display member and a frame element of the timepiece movement, wherein the support comprises:

a base including at least one first hole configured to receive a shaft for rotating the display member;

a first arm extended from the base and arranged in such a way as to be able to ensure the function of a jumper for the driving star wheel; and a second arm extended from the base and arranged in such a way as to be able to act on the driving star wheel to cause the driving star wheel to rotate in order to correct information displayed in response to a predefined action of a user that deforms said second arm, wherein said second arm comprises, from said base and toward its free end terminated by an actuating pawl:

a first portion of reduced transversal dimensions followed by a second portion of transversal dimensions greater than those of said first portion; and a corrector receiving surface being formed on said second portion, wherein said support is further arranged on the frame element of the timepiece movement, in proximity to said driving star wheel, in such a way that a free end of said first arm cooperates with said driving star wheel to ensure the function of a jumper, and a free end of said second arm is situated in proximity to said driving star wheel to exert a pressure on said driving star wheel to cause said driving star wheel to rotate in response to the predefined action of the user.

6. The mechanism of claim 5, wherein said base comprises at least one second hole configured to receive the shaft for rotating the display member.

7. A timepiece movement comprising a mechanism for displaying jumping-type information, the timepiece movement comprising:

a driving star wheel;

a display member configured to be driven in rotation via said driving star wheel; and a support positioned between said display member and a frame element of the timepiece movement, wherein the support comprises:

a base including at least one first hole configured to receive a shaft for rotating the display member;

a first arm extending from the base and arranged to ensure the function of a jumper for the driving star wheel; and a second arm extending from the base and arranged to act on the driving star wheel to cause the driving star wheel to rotate in order to correct the information displayed in response to a predefined action of a user that deforms said second arm, wherein said support is further arranged on the frame element of the timepiece movement, in proximity to said driving star wheel, in such a way that a free end of said first arm cooperates with said driving star wheel to ensure the function of a jumper, and a free end of said second arm is situated in proximity to said driving star wheel to exert a pressure on said driving star wheel to cause the driving star wheel to rotate in response to the predefined action of the user, wherein said base comprises at least one second hole configured to receive the shaft for rotating the display member, and wherein said mechanism is further arranged in such a way that said first and second holes define between them a segment forming a base of an isosceles triangle whose third vertex is situated on the axis of rotation of said driving star wheel.

8. The timepiece movement of claim 7, further comprising:

a display mobile comprising:

said display member and mounted to pivot in a bearing attached to said support via one of said first and second holes; and a first toothed wheel attached in rotation to said display member and arranged to be engaged with a second driving wheel attached in rotation to said driving star wheel.

9. The timepiece movement of claim 8, wherein said first wheel is configured to be driven onto a cylindrical seating of said display member.

10. The timepiece movement of claim 7, wherein said support is arranged on the frame element of the timepiece movement in such a way that a receiving surface is accessible from a side of the timepiece movement in a radial direction.

11. The timepiece movement of claim 10, wherein said support is arranged in a countersink formed in said frame element of the timepiece movement.

12. The timepiece movement of claim 7, wherein said display member is a member for displaying phases of the Moon.

13. The timepiece movement of claim 8, wherein said support is arranged on the frame element of the timepiece movement in such a way that a receiving surface is accessible from the side of the timepiece movement in a radial direction.

14. The timepiece movement of claim 9, wherein said support is arranged on a frame element of the timepiece movement in such a way that said receiving surface is accessible from a side of the timepiece movement in a radial direction.

15. The timepiece movement of claim 13, wherein said support is arranged in a countersink formed in said frame element of the timepiece movement.

16. The timepiece movement of claim 14, wherein said support is arranged in a countersink formed in said frame element of the timepiece movement.

17. The timepiece movement of claim 8, wherein said display member is a member for displaying phases of the Moon.

18. The timepiece movement of claim 9, wherein said display member is a member for displaying phases of the Moon.

19. The timepiece movement of claim 10, wherein said display member is a member for displaying phases of the Moon.

20. The timepiece movement of claim 11, wherein said display member is a member for displaying phases of the Moon.

* * * * *